US008857230B1

(12) United States Patent
Misner

(10) Patent No.: US 8,857,230 B1
(45) Date of Patent: Oct. 14, 2014

(54) LOCK FOR RETRACTABLE TRUCK BED COVERS

(71) Applicant: The Eastern Company, Wheeling, IL (US)

(72) Inventor: Michael O. Misner, Lake Villa, IL (US)

(73) Assignee: The Eastern Company, Wheeling, IL (US)

( * ) Notice: Subject to any disclaimer, the term of this patent is extended or adjusted under 35 U.S.C. 154(b) by 71 days.

(21) Appl. No.: 13/986,196

(22) Filed: Apr. 10, 2013

(51) Int. Cl.
*E05B 13/10* (2006.01)
*E05C 3/02* (2006.01)
*E05B 83/16* (2014.01)

(52) U.S. Cl.
CPC ..... *E05B 83/16* (2013.01); *Y10S 70/54* (2013.01); *Y10S 70/69* (2013.01); *Y10S 292/31* (2013.01); *Y10S 292/53* (2013.01); *Y10S 292/60* (2013.01); *Y10S 292/61* (2013.01)
USPC ..... 70/208; 70/210; 70/DIG. 54; 70/DIG. 69; 292/229; 292/251; 292/336.3; 292/DIG. 31; 292/DIG. 53; 292/DIG. 60; 292/DIG. 61

(58) Field of Classification Search
USPC ..... 70/208, 210, 215, 224, 461, DIG. 54, 70/DIG. 55, DIG. 69; 292/251, DIG. 11, 292/DIG. 31, DIG. 60, DIG. 61, DIG. 73, 292/229, 113, 210, 129, 181, 247; 296/100.07, 100.16
See application file for complete search history.

(56) References Cited

U.S. PATENT DOCUMENTS

| | | | | | |
|---|---|---|---|---|---|
| 1,547,906 | A * | 7/1925 | Cross | 292/210 |
| 4,061,373 | A * | 12/1977 | Revell | 292/251 |
| 4,307,905 | A * | 12/1981 | Poe et al. | 292/200 |
| 4,365,831 | A | 12/1982 | Bourne | 292/229 |
| 4,413,849 | A | 11/1983 | Davis et al. | 292/229 |
| 4,693,503 | A * | 9/1987 | Bisbing | 292/210 |
| 5,267,762 | A | 12/1993 | Gromotka | 292/229 |
| 5,454,239 | A * | 10/1995 | Esaki et al. | 70/208 |
| 5,609,373 | A | 3/1997 | Gromotka | 292/229 |
| 5,638,709 | A | 6/1997 | Clavin | 70/208 |
| 6,513,841 | B1 | 2/2003 | Jackson | 292/214 |
| 6,578,884 | B2 * | 6/2003 | Chiang | 292/66 |
| 6,606,889 | B1 | 8/2003 | Tweedy | 70/208 |
| 6,913,297 | B2 | 7/2005 | Jackson et al. | 292/196 |
| 6,969,824 | B2 | 11/2005 | Silvestro | 219/133 |
| 7,159,283 | B2 * | 1/2007 | Chang et al. | 24/458 |
| 7,185,926 | B2 | 3/2007 | Helsley et al. | 292/113 |
| 7,600,796 | B2 | 10/2009 | Liang et al. | 292/338 |
| 7,695,029 | B2 * | 4/2010 | Ramsauer | 292/67 |
| 8,118,334 | B2 * | 2/2012 | Ramsauer | 292/251 |
| 8,356,844 | B2 | 1/2013 | Baic et al. | 292/205 |
| 2011/0101710 | A1 * | 5/2011 | Elbrecht et al. | 292/202 |

* cited by examiner

*Primary Examiner* — Lloyd Gall
(74) *Attorney, Agent, or Firm* — David A. Burge

(57) ABSTRACT

A lock for a retractable cover which overlies a bed of a pickup truck has a cover-connectable housing and a handle that pivots relative to the housing for clamping a pointed tip of a flexibly mounted fastener into engagement with a nearby member such as a guide rail extending along one side of the bed of a pickup truck to retain a housing-connected retractable cover in a chosen position. A push button trigger pivoted on the handle is depressable to unlatch the handle and thereby release the clamping action of the handle. A torsion spring biases the trigger relative to the handle. A compression spring biases the handle relative to the housing. A leaf spring flexibly mounts the fastener on the handle. A key-operated plug assembly may retain the trigger in a latched position.

20 Claims, 7 Drawing Sheets

LOCK FOR RETRACTABLE TRUCK BED COVERS

BACKGROUND

Retractable covers for overlying rear load carrying compartments or "beds" of pickup trucks are disclosed in a number of patents, and example being U.S. Pat. No. 6,276,735. One form taken by such covers utilizes a plurality of substantially identical, elongate, slat-like members or the equivalent which extend laterally between extruded guide rails of substantially identical and uniform cross-section that extend along upper regions of opposite sides of the bed of a pickup truck. The laterally extending slat-like members are flexibly joined to provide a lengthy cover that can be compactly retracted into a coil in much the same manner as the cover of a rolltop desk. A retractable cover which has gained wide acceptance is sold by Applied Products, Inc. of Grand Forks, N. Dak. 58201 under the trademark RETRAX. RETRAX brand retractable covers may be viewed at www.retrax.com.

To retain a RETRAX cover closed or in selected open positions, a lever latch has been used, such as is disclosed in U.S. Pat. No. 5,609,373. The lever latch provides a cover-connectable housing on which a handle pivots toward and away from a closed position where the handle causes a flat head of a cap screw carried by the handle to be clamped against one of the two guide rails that extend along upper regions of opposite sides of the bed of a pickup truck. The lever latch has a depressable push button trigger for releasing the clamping action of the closed and latched handle, and makes double-duty use of a single torsion spring not only to bias the handle toward an open and unlatched position relative to the housing, but also to bias the push button trigger toward a normal and non-depressed position relative to the handle.

The cap screw of the lever latch that has its flat head clamped into engagement with a guide rail is threaded through a portion of the handle of the lever latch, and is securely held in place by a lock nut. To maintain proper operation of the lever latch assembly, frequent adjustment of the cap screw often is needed to correct for wear and to accommodate such variations as are encountered along the length of the extruded guide rail as it is jostled and bumped about during the wear and tear of a lengthy service life of the retractable cover. A two-handed, two-tool effort is required to adjust the combination of the cap screw and the locknut. As such, the process of frequently adjusting the cap screw of the lever latch is both tedious and time consuming.

Problems of a more serious character may arise when the variations encountered along the length of the guide rail require an adjustment of the cap screw which enables the lever latch assembly to properly grip the guide rail while positioned at one location therealong, but which renders the lever latch assembly incapable of properly gripping the guide rail when the lever latch is at other locations along the length of the guide rail. When this situation is encountered, the retractable cover is only capable of being held securely in some partially open or closed locations, but not when the retractable cover is moved to other partially open or closed locations—which is quite unacceptable. Customers expect the costly retractable covers they have purchased to be capable of being retained and locked anywhere that the customers have chosen to position their covers along the lengths of the guide rails that support opposite sides of the covers.

The disclosures of the patents identified above are incorporated herein by reference.

SUMMARY

The present invention addresses the foregoing and other drawbacks of the prior art by providing improved lockable latch assemblies, or locks, for securely, reliably and releasably retaining retractable covers in closed and in various open positions overlying the load carrying compartments or "beds" of pickup trucks and the like. Although locks embodying features of the present invention are suitable for use in a wide variety of industrial and commercial applications, they are particularly well suited to upgrade and replace the lever latches of U.S. Pat. No. 5,609,373 that have been used on retractable covers for overlying the rear load carrying compartments or beds of pickup trucks.

A lockable latch assembly, or lock, that embodies features of the present invention ordinarily can perform quite nicely for extended periods of time without requiring any adjustment at all to perform properly in securely releasably gripping a guide rail along which a retractable cover of the RETRAX type moves to close or partially close the load carrying compartment of a pickup truck or the like. If adjustment of the lockable latch assembly, or lock, is eventually needed, such adjustment is much easier to effect than was the case with lever latches of the type disclosed in U.S. Pat. No. 5,609,373.

Some embodiments of the present invention provide a lockable latch assembly, or lock, that clamps a pointed tip of a flexibly supported fastener firmly into engagement with a nearby member such as a guide rail to ensure that the lock (and whatever the lock is connected to, typically a retractable cover) does not move along or relative to the guide rail. Such an arrangement provides a significant improvement when compared to the rigidly supported, flat cap screw head that is clamped against a significant guide rail surface area in accordance with the lever latch that is disclosed in U.S. Pat. No. 5,609,373.

Some embodiments of the present invention employ springs of widely differing character that are selected to make best use of their performance characteristics 1) to bias a pivotal handle of the lock toward a closed position where the handle firmly clamps the pointed tip of a set screw fastener against a elongate guide rail, 2) to bias a push button trigger of the lock toward a latched position where the trigger retains the handle in the closed position, and 3) to flexibly mount on the handle the set screw fastener which has the pointed tip that is clamped by the handle into secure engagement with the guide rail. Such an arrangement represents a significant improvement over the single-spring lever-latch of U.S. Pat. No. 5,609,373.

In some embodiments, a relatively strong torsion spring is selected for use, but only to bias the handle of the lock toward a closed, latched position relative to the housing of the lock—a position where the handle clamps the hardened, pointed tip of a set screw type fastener securely into engagement with a surface of an elongate guide rail, thereby making optimum use of a strong torsion spring precisely as is needed to perform its one function well during a lengthy service life of the lock.

In some embodiments, a relatively gentle compression coil spring is selected for use, but only to bias the push button trigger of the lock toward a normally latched position relative to the handle of the lock—a position where the trigger latches the handle in a closed, non-operated position, thereby making optimum use of a relatively lightweight and gentle-acting compression coil spring precisely as is needed to perform its one function well during a lengthy service life of the lock.

In some embodiments, a relatively stiff yet bendable leaf spring is used to flexibly mount a pointed-tip-type fastener on the handle in a way that will cause the pointed tip of the fastener to forcefully engage a surface of a guide rail to retain the lock and a retractable cover on which it is mounted in a customer-selected position. Such an arrangement permits the fastener to move automatically toward and away from the guide rail as may be needed to accommodate variations in the guide rail without any need for physical adjustment of the fastener. However, should any adjustment of the fastener eventually be needed, the set screw that preferably comprises the fastener can be turned by the single-handed use of a simple conventional Allen wrench—which is neither tedious nor time consuming.

DESCRIPTION OF THE DRAWINGS

A fuller understanding of the present invention may be had by referring to the description and claims that follow, taken in conjunction with the accompanying drawings, wherein:

DETAILED DESCRIPTION

Figure 1:
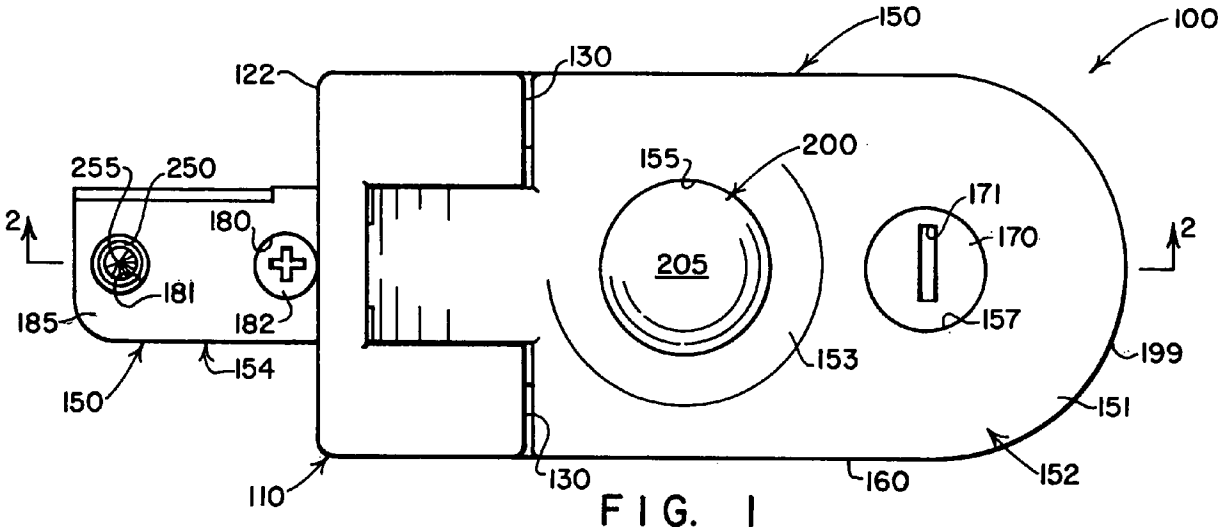
FIG. 1 is a top plan view of a lock that embodies features of the present invention, with a handle of the lock shown latched in a closed position.

Referring to FIG. 1, a lockable latch assembly or lock 100 embodying features of the present invention is indicated generally by the numeral 100. Referring to the exploded view of FIG. 9, the lock 100 includes a generally rectangular base or housing 110, a complexly configured handle 150 that is pivotally connected to the base or housing 110 by a pivot pin 140, and a push button trigger 200 that is pivotally connected to the handle 150 by a roll pin 210.

As will be explained, a feature of the lock 100 resides in the use made by the lock 100 of a pointed-tip-type threaded fastener 250 carried by a leaf spring 275 that is connected to the handle 150—an arrangement that flexibly mounts the fastener 250 on the handle 150. As will be explained, the flexible mounting of the fastener 250 enables a pointed tip 255 of the fastener 250 to be securely but resiliently clamped against an elongate guide rail 300 (such as is shown in cross-section in FIG. 14) when the handle 150 of the lock 100 is latched in the closed position that is shown in FIGS. 1-4 and 14.

Figure 14:
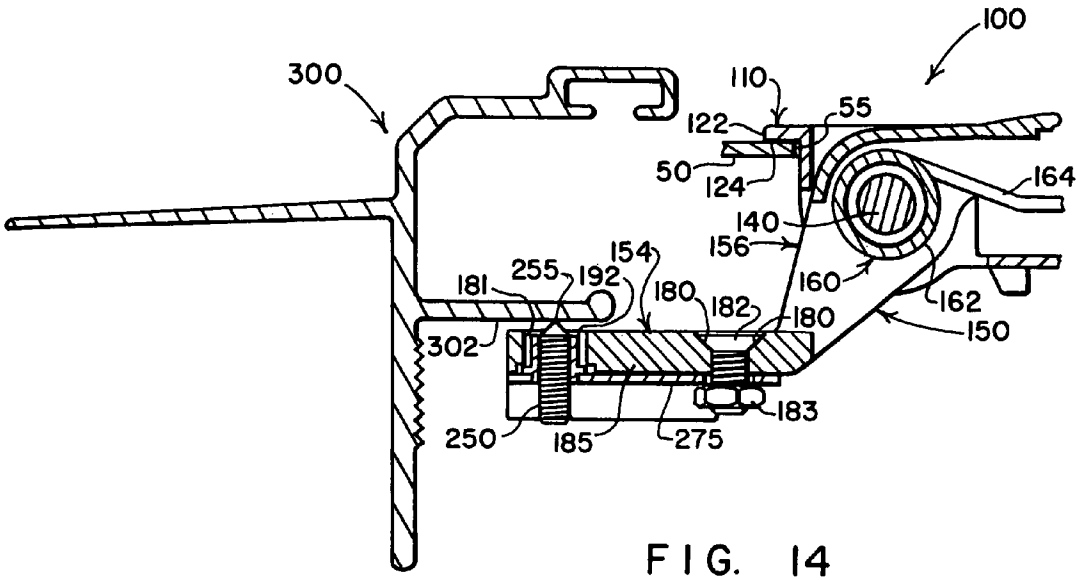
FIG. 14 is a sectional view which reproduces a selected portion of FIG. 2, with the view also showing, in cross-section, an extruded guide rail having a surface that is firmly engaged by the pointed-tip-type fastener of the lock when the handle of the lock is in the closed and latched position shown in FIGS. 1-4; and, FIG. 15 is a sectional view that repeats a selected portion of the sectional view of FIG. 14, with the view also showing in a much exaggerated depiction, how a leaf spring that flexibly supports the pointed-tip-type fastener may bend or deflect to move the pointed-tip-type fastener toward and away from the rail to automatically compensate for such minor variations as may be encountered along a length of the guide rail.

The elongate guide rail 300 may assume a wide variety of cross-sectional configurations, one example being shown in FIG. 14, and another being indicated by the numerals 16*a* and 16*b* in the aforementioned U.S. Pat. No. 6,276,735, the disclosure of which is incorporated herein by reference. A retractable cover (such as is shown in U.S. Pat. No. 6,276,735, or as is shown at www.retrax.com) that extends between two guide rails (having identical cross sections, for instance of the character shown in FIG. 14) can be opened and closed to provide or restrict access to the rear load carrying compartment or bed of a conventional pickup truck, such as is shown in U.S. Pat. No. 6,276,735.

The lock 100 is typically mounted on a retractable cover (portions of which are indicated by the numeral 50 in FIGS. 5 and 14) that is movable along guide rails (such as the guide rail 300 shown in FIG. 14) between a cover-closed position and various cover-open positions. The ability of the leaf spring 275 to deflect or to bend slightly as by flexing away from a lower portion 154 of the handle 150 (in a manner shown with some exaggeration in FIG. 15) provides a flexible mount for the fastener 250—a flexible mount which ensures that the pointed tip 255 of the fastener 250 will be clamped firmly against a surface 302 of the rail 300 (as is depicted in FIG. 14) even when the surface 302 of the rail 300 varies slightly in position along the length of the elongate guide rail 300 which typically extends for the full length of the load-carrying compartment or bed of a pickup truck or the like.

Figure 9:
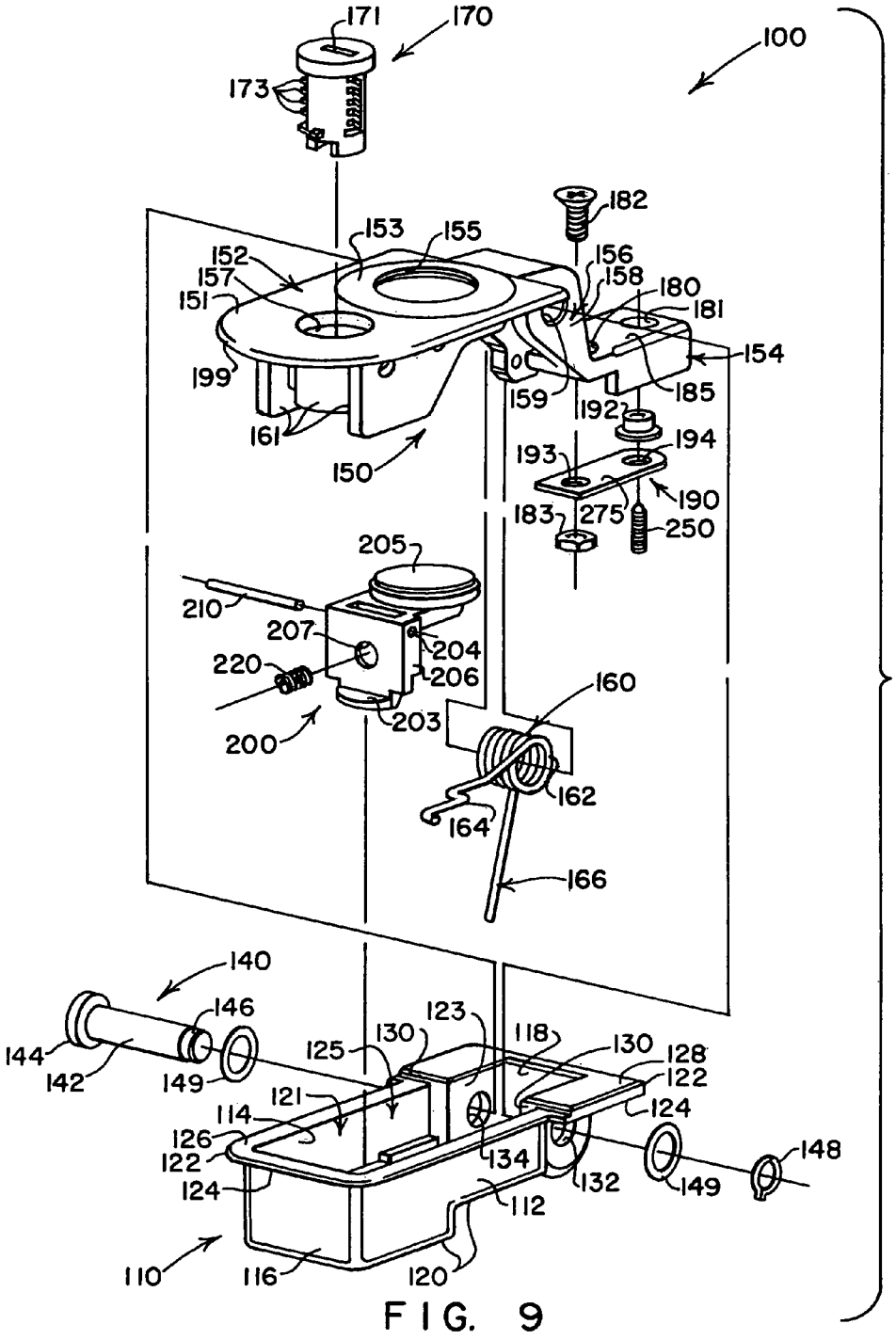
FIG. 9 is an exploded view showing selected components of the lock in disassembly.

Referring principally to the exploded view of FIG. 9, the base or housing 110 of the lock 100 is a generally rectangular, upwardly opening structure that has two spaced, parallel extending, relatively lengthy upstanding side walls 112, 114, and two spaced, parallel extending, relatively short, upstanding end walls 116, 118. A complexly configured bottom wall 120 closes a majority of the bottom of the base or housing 110. Upper portions of the side walls 112, 114 and the end walls 116, 118 join with a horizontally projecting flange 122 which extends around the perimeter of an upwardly-opening region 125 located interiorly with respect to the base or housing 110.

The perimetrically extending flange 122 has a continuous, downwardly-facing bottom surface 124 that resides in a single, substantially horizontally extending plane. The bottom surface 124 can rest atop portions 50 (FIGS. 5 and 14) of a structure such as a retractable cover to which the base or housing 110 is connected. The retractable cover (portions of which are indicated by the numeral 50 in FIGS. 5 and 14) typically has a generally rectangular opening 55 (FIG. 5) through which the side walls 112, 114 and the end walls 116, 118 of the base or housing 110 extend. If desired, a conventional thin and flat, weather resistant gasket (not shown) having the generally rectangular configuration of the bottom surface 124 of the flange 122 may be interposed between the bottom surface 124 and the upwardly-facing surface that extends about the opening 55.

Referring to FIG. 9, the perimetrically extending flange 122 of the base or housing 110 has an upwardly facing surface that includes a C-shaped upper surface 126 that extends in an imaginary upper plane 127 (see FIG. 5), and a U-shaped upper surface 128 that extends in an imaginary lower plane 129 (see FIG. 5) that parallels the upper plane 127 at a short distance therefrom. The upper and lower surfaces 126, 128 are connected by a shoulder 130 (FIGS. 5-9). As can best be seen in FIGS. 5 and 9, the shoulder 130 is located near where a relatively wide and lengthy part 121 of the interior region 125 of the base or housing 110 joins with a relatively narrower and shorter part 123 of the interior region 125 of the base or housing 110.

Referring to FIG. 9, aligned holes 132, 134 are formed through the upstanding side walls 112, 114 to permit the cylindrical body 142 of the pivot pin 140 to extend therethrough. The pivot pin 140 has an enlarged head 144 at one end of the body 142, and a perimetrically extending groove 146 located near the opposite end thereof. A retaining ring 148 is provided that is configured to engage the groove 146. Nylon washers 149 are provided for positioning on the cylindrical body 142 of the pivot pin 140, with one of the washers 149 situated adjacent the head 144, and the other situated adjacent the retaining ring 148.

The complexly configured handle 150 which is pivotally connected to the base or housing 110 by the pivot pin 140 can pivot between a closed position shown in FIGS. 1-4 and 14, and an open position shown in FIGS. 5-8. A torsion spring 160 (best shown in the exploded view of FIG. 9) has coils 162 that encircle part of the body 142 of the pivot pin 140. The torsion spring 160 has one leg 164 that presses against a portion of the handle 150, and another leg 166 that presses against a portion of the base or housing 110 to bias the handle toward the open position shown in FIGS. 5-8.

Referring to FIG. 9, the handle 150 has an upper portion 152 and a lower portion 154 that are coupled by an intermediate portion 156. The intermediate portion 156 has two spaced, parallel-extending arms 158 (best illustrated in the sectional view of FIG. 4) through which identical, aligned holes 159 (one of which is shown in FIG. 9) are formed. The body 142 of the pivot pin 140 extends through the holes 159 to mount the handle 150 for pivotal movement on the housing or base 110.

Figure 10:
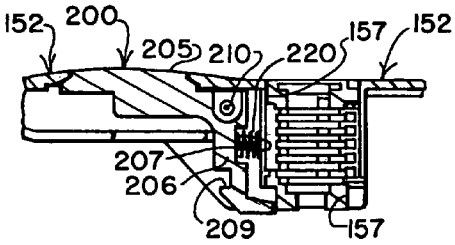
FIG. 10 is a sectional view similar to FIG. 2 showing a push button trigger of the lock in a latched and locked attitude.
Figure 12:
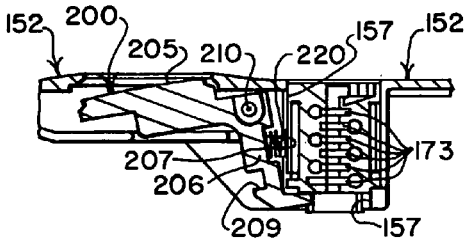
FIG. 12 is a sectional view similar to FIG. 10, but showing the push button trigger unlocked and depressed.

Referring initially to FIGS. 1, 9 and 10, the upper portion 152 of the handle 150 has a top surface 151 with a raised annular area 153 that surrounds an opening 155 through which a round button 205 of the trigger member 200 normally extends. However, as is shown in FIG. 12, the button 205 is depressable to pivot the trigger 200 to an operated position that releases the handle 150 to move from the closed position shown in FIGS. 1-4 and 14 to an open position such as is shown in FIGS. 5-8.

Figure 3:
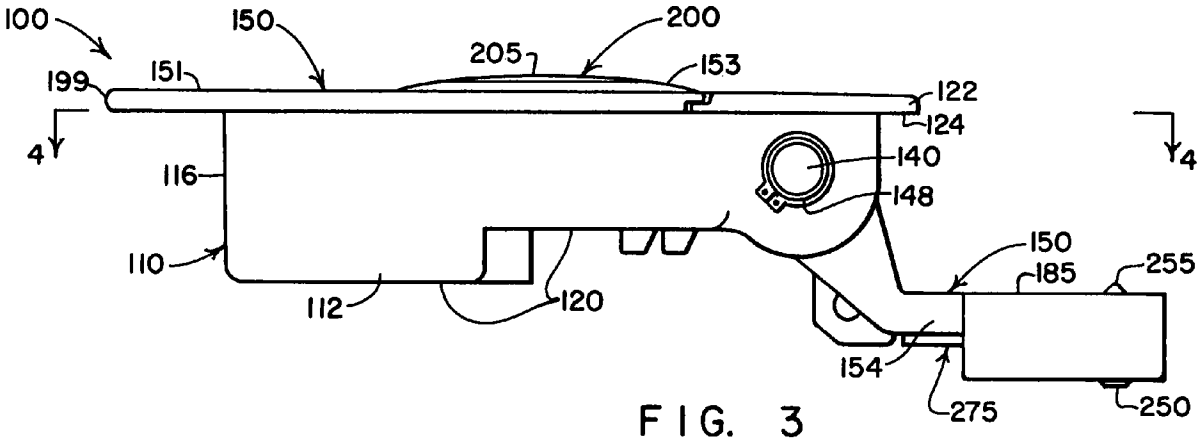
FIG. 3 is a rear side elevational view thereof.
Figure 4:
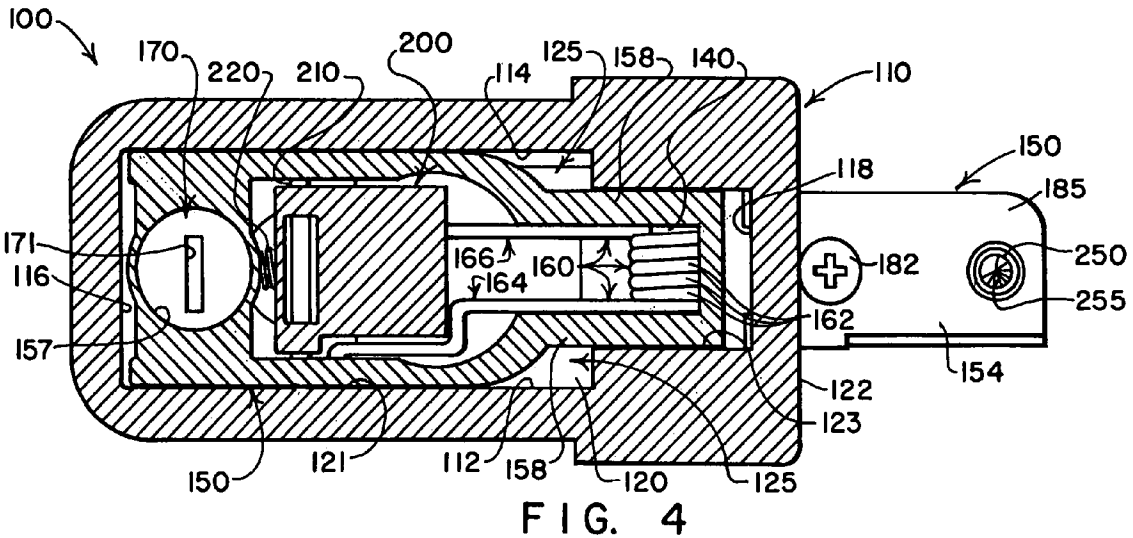
FIG. 4 is a sectional view as seen from a plane indicated by a line 4-4 in FIG. 3.
Figure 5:
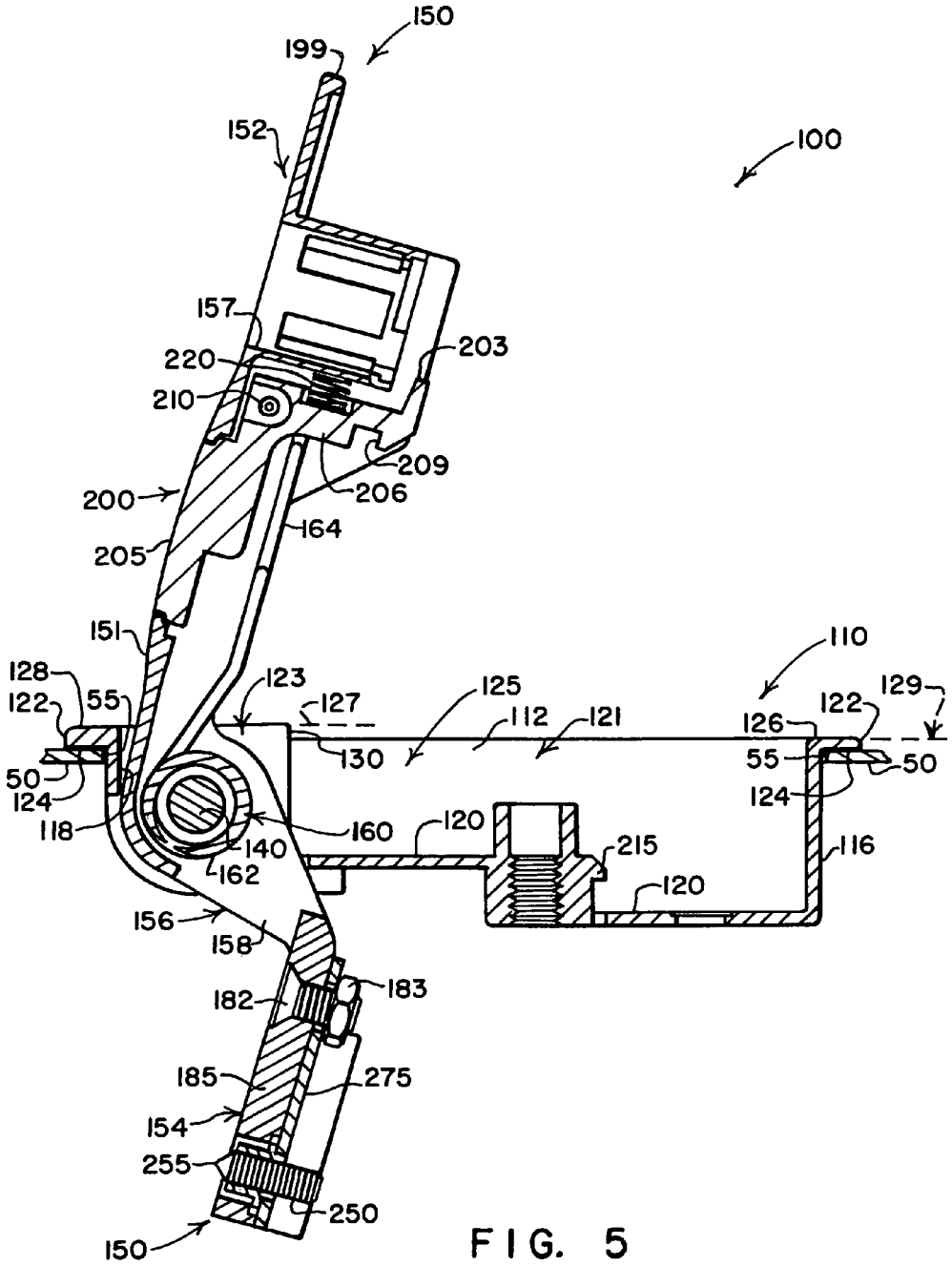
FIG. 5 is a sectional view as seen from the same plane as FIG. 2, but with the handle of the lock unlatched and pivoted to an open position.
Figure 6:
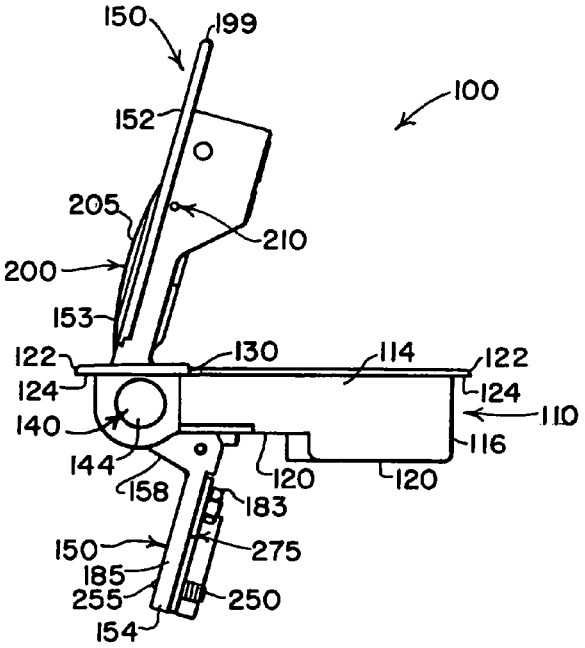
FIG. 6 is a front side elevational view on a reduced scale, with the handle of the lock pivoted to the open position.
Figure 8:
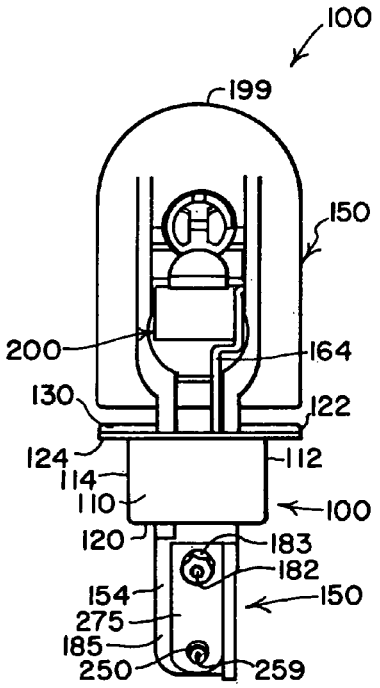
FIG. 8 is a right end elevational view thereof.
Figure 7:
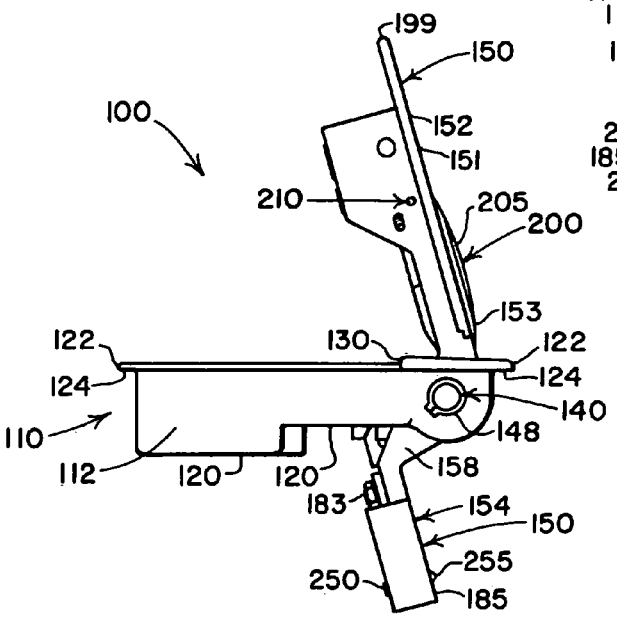
FIG. 7 is a rear side elevational view thereof.

Referring to FIGS. 1, 3 and 9, the top surface 151 is defined by a relatively thin, perimetrically extending region 199 of the upper portion 152, and by a much thicker region 161 of the upper portion 152. A major part of the relatively thin region 199 has a thickness that is approximately equal to the short distance that separates the two parallel-extending planes 127, 129 that are shown in FIG. 5. The thicker region 161 surrounds and defines a generally cylindrical plug-receiving passage 157 that opens through the top surface 151 at location spaced from the trigger button opening 155. The plug-receiving passage 157 is also open at its lower end (as can be seen in FIGS. 10-13).

The plug-receiving passage 157 has an interior configuration (not shown) that is well known to those who are skilled in the art—a configuration that is designed to receive and cooperate with a conventional key-operated plug assembly 170 (FIGS. 9, 10 and 12) which has an exterior configuration that also is well known to those who are skilled in the art. The plug assembly 170 includes a plurality of tumblers 173 (FIG. 2) that cooperate in a conventional way with interior formations of the passage 157 to permit the plug 170 to turn only a quarter rotation when a suitably configured key (not shown) is inserted into a keyhole 171 of the plug 170, and that permit the key to be removed only when the plug 170 is turned to either of the ends of its permitted quarter turn of rotation.

Figure 11:
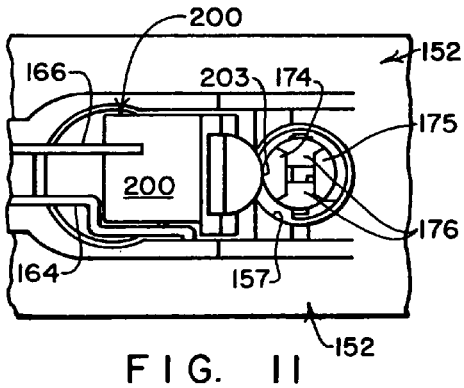
FIG. 11 is a bottom view of selected components of FIG. 10.
Figure 13:
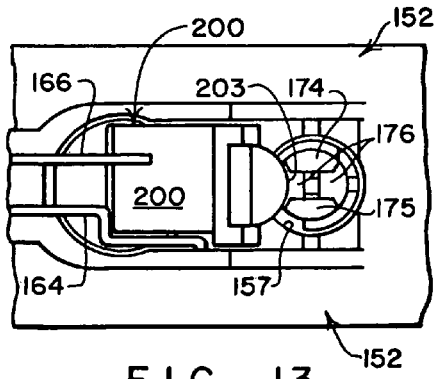
FIG. 13 is a bottom view of selected components of FIG. 12.

Referring to FIGS. 11 and 13, a bottom end region of the plug assembly 170 includes a pair of depending abutments 174, 175 that are separated by a space 176. If the plug assembly 170 is turned to a locked position such as is shown in FIGS. 10 and 11, the abutment 174 is then positioned so that, if the trigger 200 is depressed, a projection 203 of the trigger will be engaged and blocked by the abutment 174, thereby preventing depression of the trigger 200. However, if the plug 170 is turned a quarter turn to an unlocked position such as is shown in FIGS. 12 and 13, neither of the depending abutments 174, 175 obstructs depression of the trigger 200, hence the projection 203 moves into the space 176 located between the two depending abutments 174, 175.

Referring to FIGS. 1, 2, 9 and 10, the lower portion 154 of the handle 150 defines a generally rectangular projecting part 185 which has two spaced holes 180, 181 formed therethrough. The hole 180 has a tapered, countersunk formation at its upper end which receives the tapered head of a conventional Phillips head screw 182 when the screw 182 is inserted to extend through the hole 180. A nut 183 is provided for being tightened onto a threaded, lower end region of the screw 182.

One purpose for providing the screw 182 and the nut 183 is to securely attach the leaf spring assembly 190 (components of which are shown in the exploded view of FIG. 9) to the underside of the projecting part 185 of the lower portion 154 of the handle 150. Another purpose, although infrequently utilized, is to provide an easy-torelease-and-reinstall attachment that can be utilized if a leaf spring 275 (or leaf spring assembly 190) having a different degree of "bendability" or "flexibility" needs to be installed on the handle 150.

Referring to FIG. 9 (which shows the three elements of the leaf spring assembly 190 disassembled), the leaf spring assembly 190 includes a generally rectangular leaf spring 275, an internally threaded stainless steel bushing 192, and the previously mentioned threaded fastener 250 which has the pointed tip 255. In preferred practice, the fastener 250 is pointed-tip-type stainless steel set screw.

Holes 193, 194 are formed through opposite end regions of the rectangular leaf spring 275. The hole 193 is sized to permit the threaded lower end region of the screw 182 to extend therethrough. The nut 183 may be tightened in place on the screw 182 to securely attach the leaf spring assembly 190 (FIG. 9) in place on the projecting part 185 of the lower portion 154 of the handle 150.

The hole 194 is sized to permit the set screw fastener 250 to extend loosely therethrough. The internally threaded steel bushing 192 is welded to the leaf spring 275 in alignment with the hole 194 so the set screw fastener 250 can extend through the hole 194 and can be threaded into the bushing 192. The threads on the interior of the bushing 192 are sized to provide a snug or tight fit when the set screw fastener 250 is threaded into the bushing 192—which permits the set screw fastener 250 to be adjusted, but ordinarily securely retains the set screw fastener 250 in a position to which the set screw fastener 250 has been installed.

The hole 181 that is formed through the rectangular projecting part 185 of the lower portion 154 of the handle 150 is of a size that quite loosely receives the bushing 192 that is welded to the rectangular leaf spring 275. The pointed tip 255 of the set screw fastener 250 extends upwardly a significant distance out of the threaded bushing 192, and extends upwardly a significant distance out of the hole 181 that is formed through the lower portion 154 of the handle 150.

Figure 15:
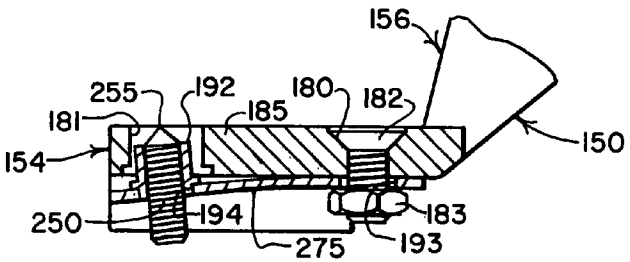

The stiff but slightly bendable nature of the leaf spring 275 taken together with the relatively large size of the hole 181 and the significant distance that the pointed tip 255 of the fastener extends upwardly out of the bushing 192 and the hole 181 ensure that, even when the leaf spring 275 bends or deforms in the much exaggerated manner shown in FIG. 15, the pointed tip 255 will still be pressed by the leaf spring 275 into firm and secure engagement with the guide rail surface 302. The relatively large size of the hole 181 permits the bushing 192 and the set screw fastener 250 to move freely within the hole 181, and permits the leaf spring 275 to bend or deflect as is shown in an enormously exaggerated manner in FIG. 15—so the pointed tip 255 of the set screw fastener 250 can move without obstruction toward and away from the surface 302 of the guide rail 300 shown in FIG. 14.

By this arrangement, if the downwardly facing surface 302 of the rail 300 should vary slightly in position along the length of the elongate rail 300, the flexible mounting of the set screw fastener 250 by the leaf spring 275 will automatically accommodate such variation without requiring any adjustment of the set screw fastener 250. If, however, wear of, or damage to, the guide rail 300 or components of the lock 100 should necessitate some minor adjustment of the set screw fastener 250, no lock nut needs to be loosened and then retightened to permit adjustment of the set screw fastener 250. Adjustment of the set screw fastener 250 simply requires the one-handed use of a conventional Allen wrench (not shown) inserted into a hex opening 259 (FIG. 8) at the lower end of the set screw fastener 250.

As will be apparent from the foregoing description, the push button trigger 200 is provided to serve as a latch for retaining the handle 150 in the closed position shown in FIGS. 1-4 and 14. Referring to FIG. 9, the trigger 200 has a generally L-shaped or right-angle appearance, which also is shown in cross-section in FIGS. 5, 10 and 12. The round push button 205 forms a substantially horizontally extending leg of the trigger 200, and a depending portion 206 forms a substantially vertically extending leg of the right-angle, generally L-shaped configuration of the trigger 200.

A hole 204 is formed through the trigger 200 in the vicinity of the junctures of the above-mentioned horizontally and vertically extending legs 205, 206 to receive the roll pin 210 which pivotally mounts the trigger 200 on the handle 150. A recess 207 is defined by the depending leg 206 to receive one end region of a compression spring 220. An opposite end region of the compression spring 220 engages the thick part 161 of the handle 150 that defines the passage 157 that contains the plug assembly 170. By this arrangement, the compression spring 220 is caused to bias the trigger toward the normal latched position shown in FIGS. 1-7, 10 and 11.

Figure 2:
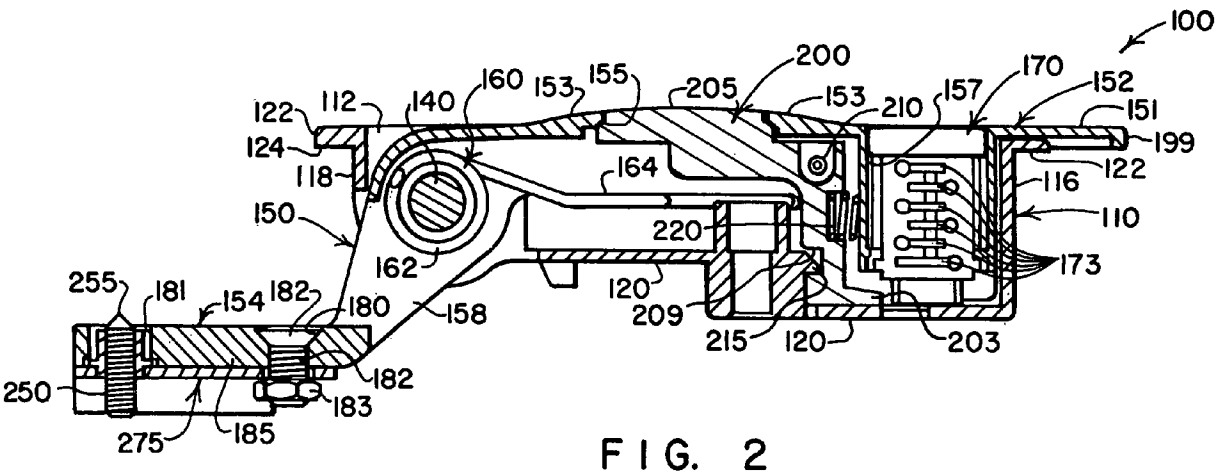
FIG. 2 is a sectional view as seen from a plane indicated by a line 2-2 in FIG. 1, with the view showing a pointed-tip-type set screw fastener that is flexibly supported by a leaf-spring of the lock.

Referring to FIG. 5, a notch 209 formed in the depending leg 206 of the trigger 200 normally engages a projection 215 (as shown in FIG. 2) formed on an interior part of the base or housing 110 normally serves to retain the handle 150 in its closed position shown in FIGS. 1-4 and 14. When the button 205 of the trigger 200 is depressed as shown in FIG. 12, the notch 209 disengages the projection 215, permitting the handle 150 to pivot to the open position shown in FIG. 5 under the influence of the torsion spring 160.

Depression of the push button 205 as shown in FIG. 12 releases the handle 150 from its closed position by moving the notch 209 out of engagement with the projection 215 defined by the base or housing 110. When a force depressing the button 205 is released, the depressed trigger 200 will return to its normal position due to the influence of the compression spring 220.

Because the surface 302 of the extruded, elongate guide rail 300 may vary in a minor way—typically by only a few thousands of an inch—in position along the length of the guide rail 300, the leaf spring 275 is provided to ensure that the pointed tip 255 of the set screw fastener 250 will always be pressed firmly against the surface 302 despite small variations in the position of the guide rail surface 302. When the lock 100 is initally brought into service, the set screw fastener 250 is adjusted (i.e., is set) so that, when the handle 150 is moved to and latched in the closed position (as shown in FIGS. 1-4 and 14), the leaf spring 275 will always be caused to be slightly bent or very slightly deflected, as is shown with great exaggeration in FIG. 15.

By adjusting the set screw fastener 250 so that the pointed tip 255 is always caused to project or extend sufficiently far from out of the hole 181 formed through the rectangular part 185 of the lower handle portion 154 to cause the leaf spring 275 (i.e., the leaf spring assembly 190) to be deflected or bent slightly (as is depicted in a much exaggerated manner in FIG. 15), the deflected or slightly bent leaf spring 275 will be caused to always press the pointed tip 255 of the set screw fastener 250 firmly and securely into engagement with the guide rail surface 302 whenever the handle 150 is moved to and is latched in the closed position as shown in FIGS. 1-4 and 14. This will be true regardless of the presence of minor variations (along the length of the extruded guide rail 300) of a few thousands of an inch in the position of the guide rail surface 302 that is engaged by the pointed tip 255 of the set screw fastener 250.

In view of the arrangement just described, a retractable cover 50 (portions of which are shown in FIGS. 5 and 14) to which the base or housing 110 is connected, will be securely retained and held in whatever position a customer positions it along the length of the guide rail 300 because the pointed tip 255 of the fastener 250 will always be pressed firmly and securely into engagement with the surface 302 of the guide rail 300. If, when the retractable cover 50 is moved to various different positions along the length of the guide rail 300, the pointed tip 255 of the fastener 250 needs to move a few thousands of an inch toward or away from the surface 302 to accommodate variations in the surface 302 that are encountered along the length of the guide rail 300, the flexible mounting of the fastener 250 by the leaf spring 275 will automatically attend to any needed movement of the pointed tip 255 toward or away from the surface 302 as the leaf spring 275 flexes automatically to maintain the biasing of the fastener 250 toward and into firm and secure engagement with the surface 302 of the guide rail 300.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

What is claimed is:

1. A lock comprising a housing; a handle that is pivotally connected to the housing for movement between a closed position wherein the handle positions a pointed tip of a fastener carried by the handle to engage with a surface along which the housing is movable, and an open position that positions the pointed tip out of engagement with the surface; a torsion spring interposed between the handle and the housing biasing the handle toward the open position; a trigger pivotally connected to the handle for movement between an unlatched position wherein the trigger disengages a formation of the housing, and a latched position wherein the trigger engages the formation to retain the handle in the closed position; a compression spring interposed between the trigger and the handle for biasing the trigger toward the latched position; and a stiff yet bendable leaf spring connected to the handle and biasing the pointed tip of the fastener into engagement with the surface when the handle is in the closed position.

2. The lock of claim 1 in which the trigger defines a push button that is accessible through an opening defined by the handle, and that is depressible to pivot the trigger away from the latched position in opposition to the action of the compression spring to release the handle from the closed position.

3. The lock of claim 2 wherein the leaf spring is an elongate piece of spring steel to which is welded an internally threaded bushing, the fastener is threaded into the bushing, and the pointed tip of the fastener projects from the bushing.

4. The lock of claim 3 wherein the fastener is a set screw that defines the pointed tip.

5. The lock of claim 3 wherein the handle has an opening into which the bushing loosely extends, and from which the pointed tip of the fastener projects.

6. The lock of claim 3 wherein the trigger is a generally L-shaped member having a push button forming one leg of the L-shaped member, and having a depending portion forming another leg of the L-shaped member, with the depending portion extending substantially perpendicular to the one leg, and with the torsion spring being positioned on an opposite side of the depending portion from the compression spring.

7. The lock of claim 6 wherein the compression spring has one end region that extends into a recess defined by the depending portion, and an opposite end region that engages a portion of the handle.

8. A lock having a housing; a handle that pivots relative to the housing between a closed position overlying the housing, and an open position extending away from the housing; a torsion spring interposed between the handle and the housing and biasing the handle toward the open position; an L-shaped trigger that pivots relative to the handle between an unlatched position disengaging a formation of the housing, and a latched position engaging the formation of the housing to releasably retain the handle in the closed position; a compression coil spring interposed between the trigger and the handle and biasing the trigger toward the latched position; and a leaf spring connected to the handle and flexibly supporting a fastener having a pointed tip relative to the handle.

9. The lock of claim 8 wherein the leaf spring is an elongate piece of spring steel having one end region fastened to the handle, and an opposite end region that supports the fastener.

10. A lock having a recess-defining housing mountable on a closure that is movable along a guide rail, a handle pivotally connected to the housing and movable relative thereto toward and away from a closed position overlying the recess, a trigger pivotally connected to the handle and movable relative thereto toward and away from a latched position where the trigger retains the handle in the closed position, with the handle supporting a leaf spring that carries a threaded fastener and deflects when the handle is in the closed position to biasingly clamp a tip of the threaded fastener into engagement with the guide rail to prevent relative movement of the closure and the guide rail.

11. The lock of claim 10 additionally including a key cylinder carried by the handle and having a key-operated plug assembly movable toward and away from a position that blocks movement of the trigger from the latched position.

12. The lock of claim 10 additionally including a torsion spring biasing the handle away from the closed position, and a compression coil spring biasing the trigger toward the latched position.

13. The lock of claim 12 wherein the torsion spring has coils that encircle portions of a pivot pin that pivotally connects the handle to the housing.

14. The lock of claim 12 wherein the compression spring is interposed between portions of the handle and the trigger.

15. The lock of claim 14 wherein the trigger has a button portion that extends through an opening defined by the handle at a time when the handle is in the closed position, and wherein the button portion is depressable relative to the opening to release the handle from the closed position.

16. The lock of claim 10 in which the threaded fastener is adjustable relative to the leaf spring to modify an extent to which the leaf spring deflects while biasingly clamping the tip of the threaded fastener into engagement with the guide rail when the handle is in the closed position.

17. The lock of claim 10 in which the handle defines an opening through which the tip of the threaded fastener extends toward the guide rail when biased by the leaf spring into engagement with the guide rail.

18. The lock of claim 10 wherein the tip of the threaded fastener is pointed.

19. The lock of claim 18 wherein the threaded fastener is a set screw.

20. The lock of claim 19 wherein the set screw is threaded through a bushing that is welded to the leaf spring.

* * * * *